United States Patent [19]

Matthews

[11] 4,272,901

[45] Jun. 16, 1981

[54] LIGHTED ADDRESS SIGN

[76] Inventor: David R. Matthews, 1613 Waltham Dr., Ann Arbor, Mich. 48103

[21] Appl. No.: 919,636

[22] Filed: Jun. 27, 1978

[51] Int. Cl.[3] ..... G09F 13/08

[52] U.S. Cl. ..... 40/574; 40/578

[58] Field of Search ..... 40/574, 578, 568, 564, 40/553

[56] References Cited

U.S. PATENT DOCUMENTS

| | | | |
|---|---|---|---|
| 1,651,084 | 11/1927 | Clark | 40/564 |
| 1,781,585 | 11/1930 | Kiefer | 40/574 |
| 1,808,456 | 6/1931 | Dwyer et al. | 40/564 |
| 1,961,865 | 6/1934 | Remington | 40/553 X |
| 2,622,356 | 12/1952 | Valente | 40/575 X |
| 2,858,631 | 11/1958 | Jorick, Jr. | 40/564 |

FOREIGN PATENT DOCUMENTS

| | | | |
|---|---|---|---|
| 1455173 | 11/1976 | United Kingdom | 40/564 |

*Primary Examiner*—John F. Pitrelli
*Assistant Examiner*—G. Lee Skillington
*Attorney, Agent, or Firm*—Reising, Ethington, Barnard, Perry & Brooks

[57] ABSTRACT

An address sign, especially for houses and other buildings, is provided with full time lighting so that the sign is easily readable under both day time and night time conditions from long distances. The lighted sign also provides low intensity illumination in a localized area such as a house entrance. The sign comprises a back plate and a translucent box-like cover having a length about four times greater than its width. A plurality of at least four miniature lamps are disposed on the back plate along the center line of the cover with certain spacing from each other and the front and side panels of the cover to provide uniform illumination of the cover. Opaque numbers are secured to the front panel of the cover and are preferably black to provide high contrast for easy day time and night time reading. The lamps are energized from a door bell transformer and are connected in series so that the voltage on each lamp is substantially below the rated voltage to provide an expected life much greater than the normal life expectancy.

3 Claims, 3 Drawing Figures

LIGHTED ADDRESS SIGN

TECHNICAL FIELD

This invention relates in general to lighted signs and, in particular, a sign for displaying a street address on a house or other building.

BACKGROUND ART

Address signs for houses and other buildings conventionally take the form of a set of individual numbers which are formed of metal or plastic and are mounted upon a suitable mounting surface. Such address signs are typically illuminated by the ambient light or sometimes by a special front lighting arrangement to improve the readability. The conventional address sign does have the advantage of being inexpensive and of being easy to install; however, it falls far short of the desired degree of readability. In particular, the conventional address sign does not provide the desired readability from a distance so that it is useful for persons seeking the address from their car.

DISCLOSURE OF THE INVENTION

In accordance with this invention, an address sign is provided which is easily readable from a long distance under both day time and night time conditions. This is provided by a translucent back lighted panel with opaque numbers thereon with full time uniform intensity of illumination.

Further, in accordance with this invention, a lighted address sign is provided which affords good readability of the address numbers during both day and night conditions and which provides a low level ambient lighting in a localized area during night time. This is provided by a sign which includes a box-like translucent cover having a front panel provided with opaque numbers and side panels which cast light in all directions from the sign.

Further, according to this invention, a lighted address sign is provided which has a box-like translucent cover which is backlighted by a plurality of miniature incandescent lamps spaced from each other and from the front and side panels of the cover so that the panels are illuminated with uniform intensity to enhance the readability of the numbers and provide a soft ambient lighting.

Further, according to this invention, a lighted address sign is provided which is easy to install with connection to a low voltage source and which is relatively maintenance free using conventional lamps operated in a manner to provide unusually long service life before replacement is required. This is provided by using miniature incandescent lamps and connecting them in series across the low voltage output terminals of a door bell transformer so that the lamps are operated at less than their rated voltage.

According to this invention, a lighted address sign comprises an elongated rectangular back plate having a length about four times greater than its width with a box-like cover of translucent material disposed over the back plate. A set of at least four miniature incandescent lamps are mounted on the back plate and disposed on the longitudinal center line thereof and a plurality of alphanumeric characters of opaque material are disposed on the front panel of the cover and disposed in spaced relation along the longitudinal center line. The lamps are spaced so that the distance between adjacent lamps is about twice the distance from each lamp to the nearest side panel of the cover and the front panel of the cover is spaced further from the lamps than the side panels but less than the distance between adjacent lamps. In this arrangement the front panel is illuminated with uniform intensity over the entire surface to enhance the readability of the characters from a distance and the side panels have a minimized front-to-back dimension and are illuminated with uniform intensity to provide low level ambient lighting.

A more complete understanding of this invention may be obtained from the detailed description which follows, taken with the accompanying drawings.

BEST MODE FOR CARRYING OUT THE INVENTION

Figure 1:
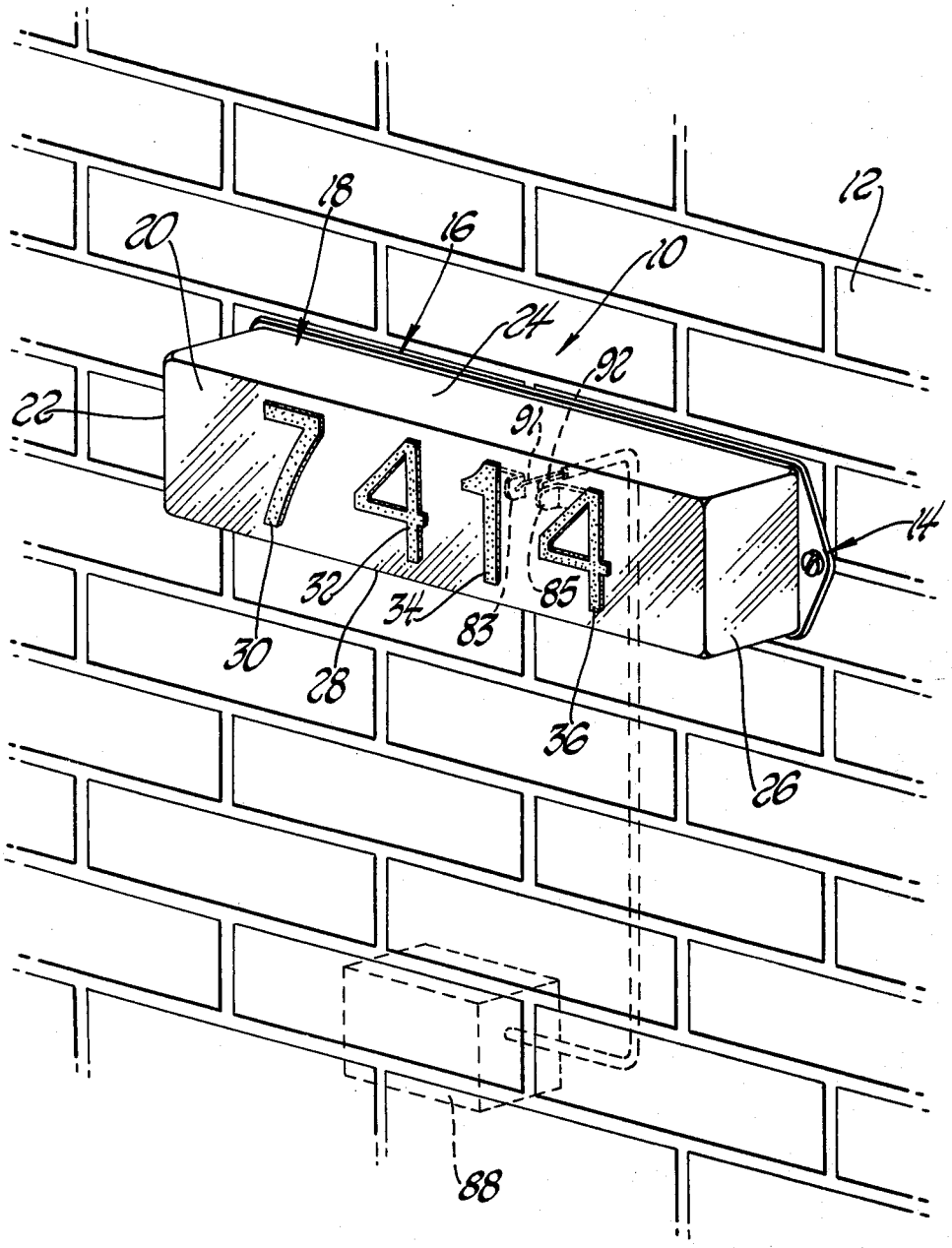
FIG. 1 is a perspective view showing a lighted address sign constructed according to this invention.

Referring to FIG. 1, a lighted address sign constructed according to the present invention is generally indicated at 10. The sign 10 is mounted on a vertical wall 12 by means of mounting screws 14 (only one of which is shown). The sign includes a housing 16 with a back plate 68 of elongated rectangular shape. The back plate has a length about four times its width and is suitably made of an acrylic plastic. The housing 16 includes a rectangular box-like cover 18 having a front panel 20 and unitary side panels 22, 24, 26 and 28. The front panel 20 is of the same shape as the back plate and is disposed parallel thereto in spaced relationship with the edges of the side panels seated against the back plate. The cover is constructed of a translucent acrylic plastic material having certain light transmissibility properties and will be described more fully below. Opaque characters 30, 32, 34 and 36 are disposed on the front panel 20 and represent, for example, the street address of the house. The characters 30 through 36 may be any alphanumeric character and are preferably made of black plastic sheet provided with a pressure sensitive adhesive for mounting on the front panel 20. The characters, 30 through 36, selectively block the transmission of light and thereby provide a high degree of contrast when the light 10 is energized.

The back plate 68 is provided with two mounting flanges 69 and 71 at opposite ends of the plate. Similarly, the cover 20 is provided with mounting flanges 73 and 75 which respectively overlie the flanges 69 and 71. The screws 14 extend through the flanges to mount the sign on the wall 12 and to secure the cover 18 to the back plate 68 to form a closed housing. Expansible screw anchors 96 on the respective screws 14 are adapted to seat in the wall to mount the sign 10 on the wall.

Figure 2:
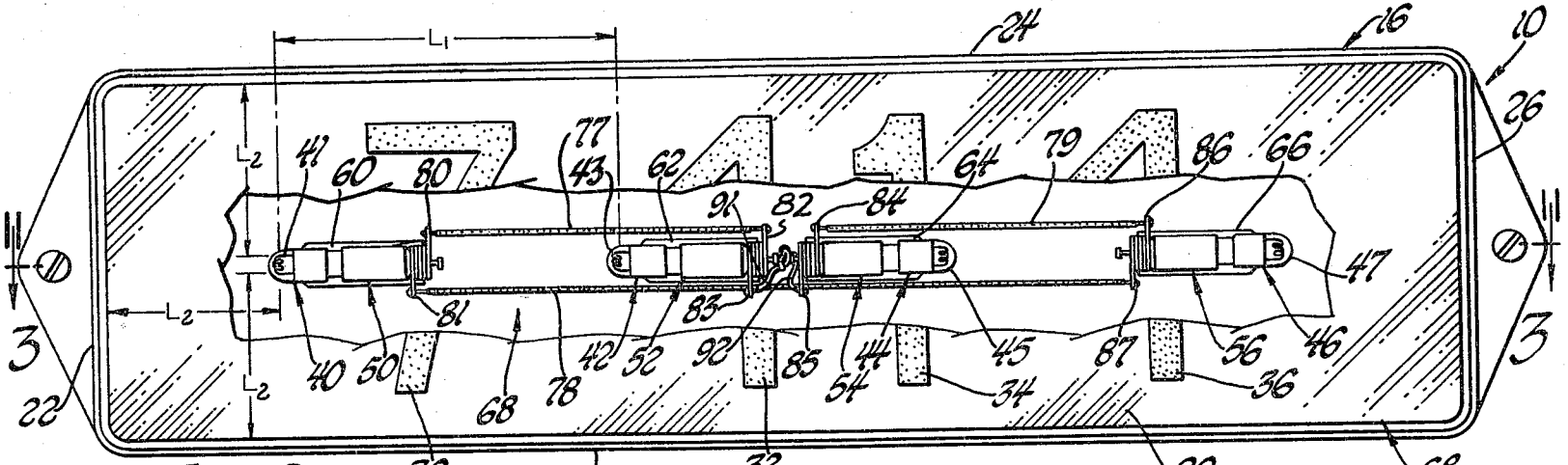
FIG. 2 is a front view, partially broken away.

As shown in FIG. 2, the sign 10 also includes a plurality of incandescent lamps 40, 42, 44 and 46. The lamps are removably secured in lamp sockets 50, 52, 54 and 56, respectively, which are provided with mounting brackets 60, 62, 64 and 66. The mounting brackets are secured to the back plate 68 of the housing 16 by fasteners 70, 72, 74, and 76, respectively.

The lamps, 40, 42, 44 and 46, and their lamp sockets, 50, 52, 54 and 56, respectively, are electrically connected in series by conductors 77, 78 and 79. The conductor 77 electrically connects terminals 80 and 82 of the lamp sockets 50 and 52, respectively. The conductor 78 electrically connects terminals 81 and 87 of the lamp sockets 50 and 56, respectively. The conductor 79 electrically connects terminals 86 and 84 of the lamp sockets 56 and 54, respectively. The terminals 83 and 85 are electrically connected to a doorbell transformer 88, shown in phantom in FIG. 1, through a pair of conductors 91 and 92. The conductors 91 and 92 extend through an aperture 93 in the back plate 68. The pair of conductors are connected at their ends inside the housing to the respective terminals 83 and 85 by soldering. The pair of conductors are connected at their other ends to the transformer 88.

The transformer 88 is preferably a conventional doorbell transformer rated for 120 volts input at its primary terminals and 16 volts output at its secondary terminals. It is adapted to have its primary terminals connected with the conventional house supply voltage of 120 volts. However, a doorbell transformer having an output voltage rating in the range of 10 to 22 volts is satisfactory. Instead of a doorbell transformer, a receptacle plug in type transformer is satisfactory if the doorbell transformer 88 is inaccessible to the sign 10. As shown in FIG. 1, the wires 91 and 92 are connected directly to the transformer 88. Alternatively, the wires can be electrically connected, as shown in FIG. 3, to the terminals on the doorbell button switch 89 to supply the needed voltage to the sign 10 without disturbing the function of the doorbell button.

The cover 18 is symmetric about a horizontal plane, as viewed in FIG. 1, extending through the front panel 20 along the longitudinal center line of the cover 18. The filaments 41, 43, 45 and 47 of the lamps 40, 42, 44 and 46, respectively, are disposed along the longitudinal center line of the cover 18 on a line contained within the plane. Adjacent filaments such as filaments 41 and 43, are spaced a first predetermined distance, L1, from each other, and each filament is spaced a second predetermined distance, L2, equal to approximately one-half the first predetermined distance, L1, from each immediately adjacent side panel 22, 24, 26 or 28, as shown in FIG. 2. In other words, the distance from a particular filament to the closest side panel is equal to about one-half the distance from that filament to the immediately adjacent filament.

Figure 3:
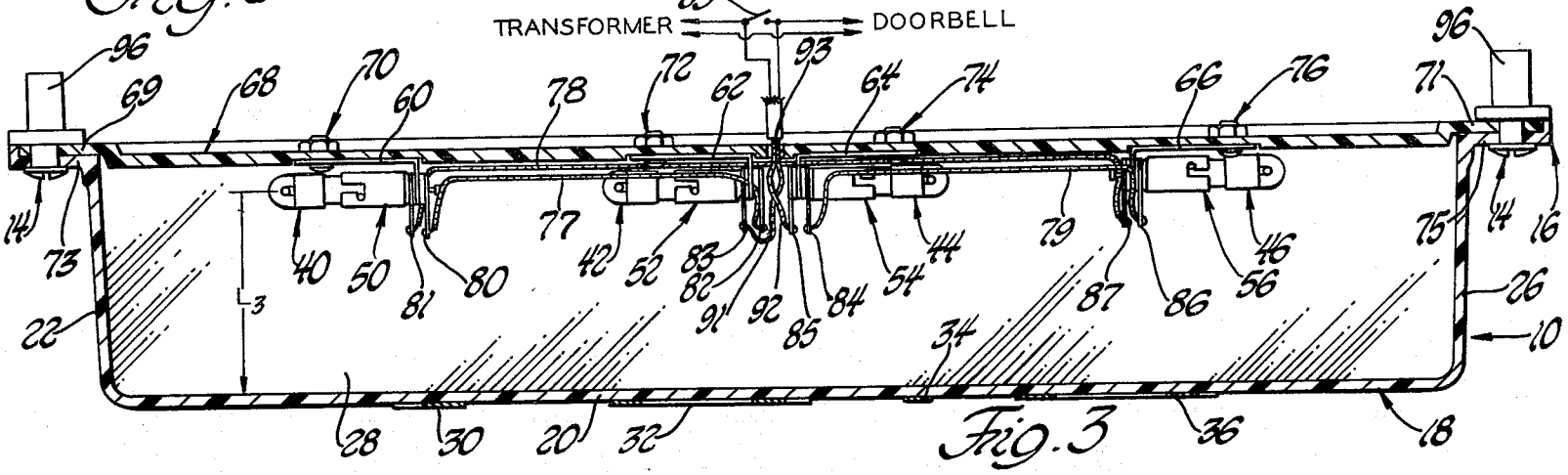
FIG. 3 is a sectional view taken along lines 3—3 of FIG. 2.

As shown in FIG. 3, the distance L3 from each of the filaments of the lamps 40, 42, 44 and 46 to the front panel 20 is greater than the second predetermined distance, L2, and less than the first predetermined distance, L1. If the distance, L3, between the filaments and the front panel 20 of the cover 18 is made smaller, the lamps 40, 42, 44 and 46, become apparent "hot spots" and the lighting provided by the sign 10 does not appear to be uniform. This causes the characters 30 through 36, to be unreadable at 150 feet. If the distance, L3, is reduced even more, the lamp filaments 41, 43, 45 and 47 can actually be seen through the cover. This further impairs the readability and appearance of the sign 10. The spacing of the lamps 40, 42, 44 and 46 from each other and from the side panels, 22 through 28, provides a uniform amount of light energy impinging upon the side panels thereby providing relatively uniform lighting. Internal reflections within the housing 16 and within the translucent acrylic material causes the lighting to appear to be uniform when the acrylic plastic used has a light transmission factor in a range of 0.28 to 0.32. If the material of the housing 16 had a higher transmission factor, the light assembly 10 would appear gray in daylight and would appear orange at night. If a material having a smaller transmission factor were used the wattage of the lamps 40, 42, 44 and 46 would have to be increased substantially.

The lamps 40, 42, 44 and 46 preferably comprise miniature 6.3 volt Cm-1866 lamps manufactured by the Chicago Miniature Lamp Company. With a supply voltage of 16 volts each of the four lamps exhibits a voltage drop of only 4 volts which is substantially less than the rated voltage. Accordingly, the expected life of the lamps is greatly increased over that for rated voltage. This also conserves energy and the low light intensity enhances the aesthetic appearance of the sign. The sign may be energized 24 hours a day without the appearance of being lighted in the daytime and yet with four lamps and six characters and power consumption less than three watts it is capable of being read day or night, from a distance of 150 feet or more. A parallel connection of lamps could be used but special lamps would be required and it is preferred to use the above-mentioned lamps in series because they are commercially available at low cost.

The cover is made of an acrylic plastic having a light transmission factor in the range of 0.28 to 0.32. Preferably, the acrylic plastic may comprise "Plexiglass" made by Rohm and Hass Company, identified as V(811) white 647-40 for panels 0.1 inch thick or white 859 for panels 0.12 inch thick. Alternatively, the acrylic plastic may comprise Dupont "Lucite" 40 or 140 white WT-75 meeting ASTM standard D788 grade 8. The acrylic cover 18 maintains its white translucency and does not yellow thereby obviating the necessity for replacing or painting the cover 18 through wear or exposure of the cover 18 to adverse weather conditions.

The characters, 30 through 36, as shown in FIGS. 1 and 2 may be of any height but it is preferable that they be approximately three inches in height if they are to be readable at a distance of 150 feet or more. Furthermore, in order that the characters, 30 through 36, be discernible at this distance the space between the characters and the stem or stroke width of the characters 30 through 36, should not be less than five-eighths of an inch.

While a preferred embodiment of the sign 10 has been shown and described herein in detail, those skilled in this art will recognize various alternative designs and embodiments for practicing the present invention as defined by the follow claims.

What is claimed is:

1. An address sign adapted to display a house address number or the like and to provide low intensity illumination in a localized area such as a house entrance, said sign comprising an elongated rectangular back plate being adapted to be mounted on a support member, a boxlike cover of rigid self-supporting translucent material having a rectangular front panel with a configuration the same as the back plate and being disposed in spaced parallel relationship with said back plate, said cover having a length greater than its width and comprising four side panels unitary with said front panel and extending perpendicular thereto with the edges of the side panels seated upon said back plate, a set of miniature incandescent lamps mounted on the back plate and disposed on the longitudinal center line thereof, the length of the cover being greater than the width by a factor approximately equal to the number of lamps in said set, a plurality of alphanumeric characters of opaque material disposed on one of said panels in spaced relation along the longitudinal center line, said lamps being spaced along the center line with the distance between adjacent lamps being about twice the distance from each lamp to the nearest side panel, the front panel being spaced further from the lamps than the side panels but less than the distance between adjacent lamps, said translucent material of said cover having a light transmission factor in the range of 0.28 to 0.32 whereby the front panel is illuminated with uniform intensity over the entire surface thereof to provide enhanced readability of the characters from a distance and whereby the side panels have a minimized front-to-back dimension and are illuminated with uniform intensity over the entire surface areas to provide low level ambient lighting; said back plate being provided with a first mounting flange at one end thereof and a second mounting flange at the other end thereof, the side panels of the cover at opposite ends thereof having first and second cover flanges unitary therewith in overlying relationship with the respective mounting flanges on said back plate and first fastener means extending through both of said first flanges, and second fastener means extending through both of said second flanges for securing said cover to said back plate and for securing said sign to said support member.

2. The invention as defined in claim 1 wherein the number of lamps is four and including means for securing said cover to said back plate to form a substantially closed housing for said lamps, a pair of electrical conductors extemnding through said back plate, each of said lamps being rated for operation at about six volts, all of said lamps being electrically connected in series between the ends of said pair of conductors within said housing and having a power consumption of about three watts, said pair of conductors being adapted to be connected at the other ends of the output terminals of a doorbell transformer having primary terminals connected with a supply voltage of 120 volts and having secondary terminals providing an output voltage in the range of about 10 to 22 volts, whereby said lamps are operated at a voltage substantially lower than their rated voltage thereby resulting in a reduced light intensity and prolonged lamp life.

3. The invention as defined in claim 2 wherein the secondary terminals of said transformer are connected through a doorbell switch to a doorbell, and said pair of conductors are adapted to be connected to the terminals of said switch, the current flow through said lamps being less than the current required to actuate said doorbell.

* * * * *